US007793465B2

(12) United States Patent
McCann

(10) Patent No.: US 7,793,465 B2
(45) Date of Patent: Sep. 14, 2010

(54) GUTTER GUARD

(75) Inventor: Russell Edwin McCann, Surrey (CA)

(73) Assignee: Cheruss Holdings Inc., Surrey (CA)

( * ) Notice: Subject to any disclaimer, the term of this patent is extended or adjusted under 35 U.S.C. 154(b) by 185 days.

(21) Appl. No.: 11/679,706

(22) Filed: Feb. 27, 2007

(65) Prior Publication Data

US 2008/0098661 A1 May 1, 2008

Related U.S. Application Data

(60) Provisional application No. 60/863,903, filed on Nov. 1, 2006.

(51) Int. Cl.
*E04D 13/00* (2006.01)

(52) U.S. Cl. ..... 52/12; 52/11

(58) Field of Classification Search ..... 52/11, 52/12; D23/267; 210/155, 474; 4/510
See application file for complete search history.

(56) References Cited

U.S. PATENT DOCUMENTS

| | | | | |
|---|---|---|---|---|
| 2,288,121 | A | 6/1942 | Cisar et al. | |
| 4,553,356 | A * | 11/1985 | Pepper | 52/11 |
| 4,616,450 | A | 10/1986 | Shouse | |
| 4,765,101 | A | 8/1988 | Wolf | |
| 4,888,920 | A | 12/1989 | Marulic | |
| 4,907,381 | A | 3/1990 | Ealer | |
| 5,216,852 | A * | 6/1993 | Bemis et al. | 52/12 |
| 5,271,192 | A * | 12/1993 | Nothum et al. | 52/12 |
| 5,555,680 | A | 9/1996 | Sweers | |
| 5,619,825 | A | 4/1997 | Leroney et al. | |
| 6,427,388 | B1 | 8/2002 | Brochu | |
| 6,463,700 | B2 * | 10/2002 | Davis | 52/12 |
| 6,598,352 | B2 * | 7/2003 | Higginbotham | 52/12 |
| 6,786,008 | B2 | 9/2004 | Brochu | |
| 6,944,992 | B2 | 9/2005 | Brochu | |
| 6,951,077 | B1 * | 10/2005 | Higginbotham | 52/12 |
| D523,538 | S * | 6/2006 | Brochu | D23/267 |
| 7,627,991 | B1 * | 12/2009 | Feldhaus | 52/12 |
| 2004/0118052 | A1 | 6/2004 | Brochu | |
| 2005/0204642 | A1 * | 9/2005 | Valentini | 52/12 |
| 2005/0279036 | A1 | 12/2005 | Brochu | |
| 2006/0101722 | A1 * | 5/2006 | Ealer, Sr. | 52/12 |
| 2006/0107603 | A1 * | 5/2006 | Brownridge | 52/11 |

FOREIGN PATENT DOCUMENTS

DE 3615480 A1 * 11/1987

OTHER PUBLICATIONS

U.S. Appl. No. 10/017,330, filed Jun. 19, 2003, Brochu.

* cited by examiner

*Primary Examiner*—Robert J Canfield
*Assistant Examiner*—Christine T Cajilig
(74) *Attorney, Agent, or Firm*—Cameron IP

(57) ABSTRACT

A gutter guard comprises an elongate, perforated planar portion having a first longitudinal edge, a second longitudinal edge, and a plurality of apertures extending therethrough. A flange extends along the first longitudinal edge of the perforated planar portion. A sealing member extends along the first longitudinal edge of the perforated planar portion. The sealing member is angularly spaced-apart from the flange. A pair of spaced-apart side walls extend along the second longitudinal edge of the perforated planar portion. The side walls define a channel therebetween. A lip extends along a free edge of one of the side walls.

8 Claims, 3 Drawing Sheets

GUTTER GUARD

CROSS REFERENCE TO RELATED APPLICATION

This application claims the benefit of provisional U.S. application No. 60/863,903 filed on Nov. 1, 2006.

BACKGROUND

1. Field of the Invention

The present invention relates to a gutter guard, and in particular, to a unitary gutter guard that sealingly engages the longitudinal edges of a gutter.

2. Description of the Prior Art

It is well known to use gutters to collect and divert water runoff from building roofs. Gutters have a generally U-shaped cross-section defined by a pair of opposed longitudinal side walls, and a bottom wall that extends between the side walls. The longitudinal side walls each have a longitudinal edge. An upwardly facing opening is disposed between the longitudinal edges of the gutter. In use, the gutter is installed below an eave of a building. The gutter is connected to the building using fasteners, usually in the form of screws or nails, in a manner such that a longitudinal axis of the gutter is substantially parallel to a longitudinal axis of the eave. The longitudinal edge of the gutter nearest to the building may be referred to as an inner longitudinal edge, and the longitudinal edge of the gutter furthest from the building may be referred to as an outer longitudinal edge. The upwardly facing opening of the gutter receives water runoff from the building and the water is diverted to a desired collection point by the gutter. However, if leaves or other foreign debris are allowed to enter the gutter, the gutter may become clogged and the desired drainage of water may be impeded. It is therefore also known to provide gutters with gutter guards. A gutter guard prevents debris from entering the gutter while still allowing water runoff to flow into the gutter.

Conventional gutter guards have a perforated planar portion which is disposed over the upwardly facing opening of the gutter. The perforated planar portion prevents debris from entering the gutter while allowing water runoff to flow into the gutter. Clips are generally used to mount the gutter guard on the gutter. The clips are typically independent of the perforated planar portion as disclosed in U.S. Pat. No. 6,427,388 to Brochu, which is incorporated herein by reference. In U.S. Pat. No. 6,427,388 Brochu discloses a gutter guard having a first member (30) and second member (44). The first member (30) and the second member (44) are inter-engageable but they are separate components. The second member (44) has a perforated planar portion (46) that is disposed over an upwardly facing opening of a gutter (10). The first member (30) has clip members (66) that are used to mount the gutter guard to the gutter (10).

Although conventional gutter guards prevent debris from clogging the gutter, they may instead cause water runoff to seep into the building supporting the gutter. The flow of water runoff into the gutter will be restricted if openings in the perforated planar portion of the gutter guard become clogged with debris. In this circumstance, water may accumulate on the planar surface of the gutter guard. Since gutter guards similar to the one disclosed by Brochu in U.S. Pat. No. 6,427,388 do not sealingly engage the longitudinal edges of the gutter, water that has accumulated on the planar surface of the gutter guard may flow over the longitudinal edges of the gutter. Water flowing over the outer longitudinal edge of the gutter will flow down an outermost portion of the gutter causing a "tiger stripe" effect. Water flowing over the inner longitudinal edge of the gutter may seep into the building, causing damage to the building.

To prevent water from seeping into the building, gutter guards have been provided with sealing members as disclosed in U.S. Pat. No. 6,944,992, also to Brochu, and which is also incorporated herein by reference. In U.S. Pat. No. 6,944,992 Brochu discloses a gutter guard having a first member (30) and second member (44). The first member (30) and the second member (44) are inter-engageable but they are separate components. The second member (44) has a perforated planar portion (46) that is disposed over an upwardly facing opening of a gutter (10). The first member (30) has clip members (66) and a sealing member (42). The clip members (66) are used to mount the gutter guard to the gutter (10). The sealing member (42) seals an inner longitudinal edge of the gutter (10) and prevents water that has accumulated on the planar surface of the gutter guard from flowing over the inner longitudinal edge of the gutter and seeping into the building.

Gutter guards similar to the one disclosed by Brochu in U.S. Pat. No. 6,944,992 do not however provide means for sealing the outer longitudinal edge of the gutter. Water that has accumulated on the planar surface of the gutter guard may still flow over the outer longitudinal edge of the gutter and down an outermost portion of the gutter causing the "tiger stripe" effect. Furthermore, the perforated planar portion and the clips used to mount the gutter guard are still separate components. The multiplicity of components increases the cost of manufacturing the gutter guard.

The gutter guard disclosed by Brochu in U.S. Pat. No. 6,944,992 also tucks under the roof shingles. This causes the downward slope of the gutter guard to radically change depending on the roof pitch, how the gutter is positioned on the fascia board, and how much slope the gutter requires to carry the water to a downspout or drainage location. If the gutter needs to be a couple inches lower at one end to allow for drainage this may radically change the slope of the gutter guard along the length of the gutter. Changes in slope typically leads to water shooting off of the gutter guard and over the face of the gutter. Previously installed gutters systems therefore require major adjustments and additional downspout or drainage locations to accommodate the gutter guard disclosed by Brochu in U.S. Pat. No. 6,944,992.

There is therefore a need for an improved, unitary gutter guard that sealingly engages both longitudinal edges of a gutter and that may be easily installed on both new and renovated gutter systems.

SUMMARY OF THE INVENTION

According to a first aspect of the present invention, there is provided a gutter guard comprising an elongate, perforated planar portion having a first longitudinal edge, a second longitudinal edge, and a plurality of apertures extending therethrough. A flange extends along the first longitudinal edge of the perforated planar portion. A sealing member extends along the first longitudinal edge of the perforated planar portion. The sealing member is angularly spaced-apart from the flange. A pair of spaced-apart side walls extend along the second longitudinal edge of the perforated planar portion. The side walls define a channel therebetween. A lip extends along a free edge of one of the side walls.

According to a second aspect of the present invention, there is provided a gutter guard comprising an elongate, perforated planar portion having a first longitudinal edge, a second longitudinal edge, and a plurality of apertures extending therethrough. A flange extends along the first longitudinal edge of the perforated planar portion. A flexible sealing member extends along the first longitudinal edge of the perforated planar portion. The sealing member is angularly spaced-apart from the flange. A pair of resilient spaced-apart side walls extend along the second longitudinal edge of the perforated planar portion. The side walls define a channel therebetween. A lip extends along a free edge of one of the side walls.

According to a third aspect of the invention, there is provided a gutter and a gutter guard. The gutter has a generally U-shaped cross-section defined by a pair of opposed longitudinal side walls and a bottom wall that extends between the side walls. The side walls each having a longitudinal edge. Fasteners connect the gutter to a building. The longitudinal edge nearest to the building is an inner longitudinal edge and the longitudinal edge furthest from the building is an outer longitudinal edge. An upwardly facing opening of the gutter is disposed between the inner and outer longitudinal edges. The gutter guard is disposed adjacent to the upwardly facing opening of the gutter. The gutter guard comprises an elongate, perforated planar portion having a first longitudinal edge, a second longitudinal edge, and a plurality of apertures extending therethrough. A flange extends along the first longitudinal edge of the perforated planar portion. A flexible sealing member extends along the first longitudinal edge of the perforated planar portion. The sealing member is angularly spaced-apart from the flange. A pair of resilient spaced-apart side walls extend along the second longitudinal edge of the perforated planar portion. The side walls define a channel therebetween. A lip extends along a free edge of one of the side walls.

The present invention offers the advantage of providing a gutter guard that sealingly engages both longitudinal edges of different size gutters. The present invention further offers the advantage of providing a gutter guard that can be easily and inexpensively manufactured. The present invention still further offers the advantage of providing a gutter guard that may be readily installed, without tools, on existing gutter systems, without major modification, making it suitable for new and renovated gutter systems.

DESCRIPTION OF THE PREFERRED EMBODIMENTS

Figure 1:
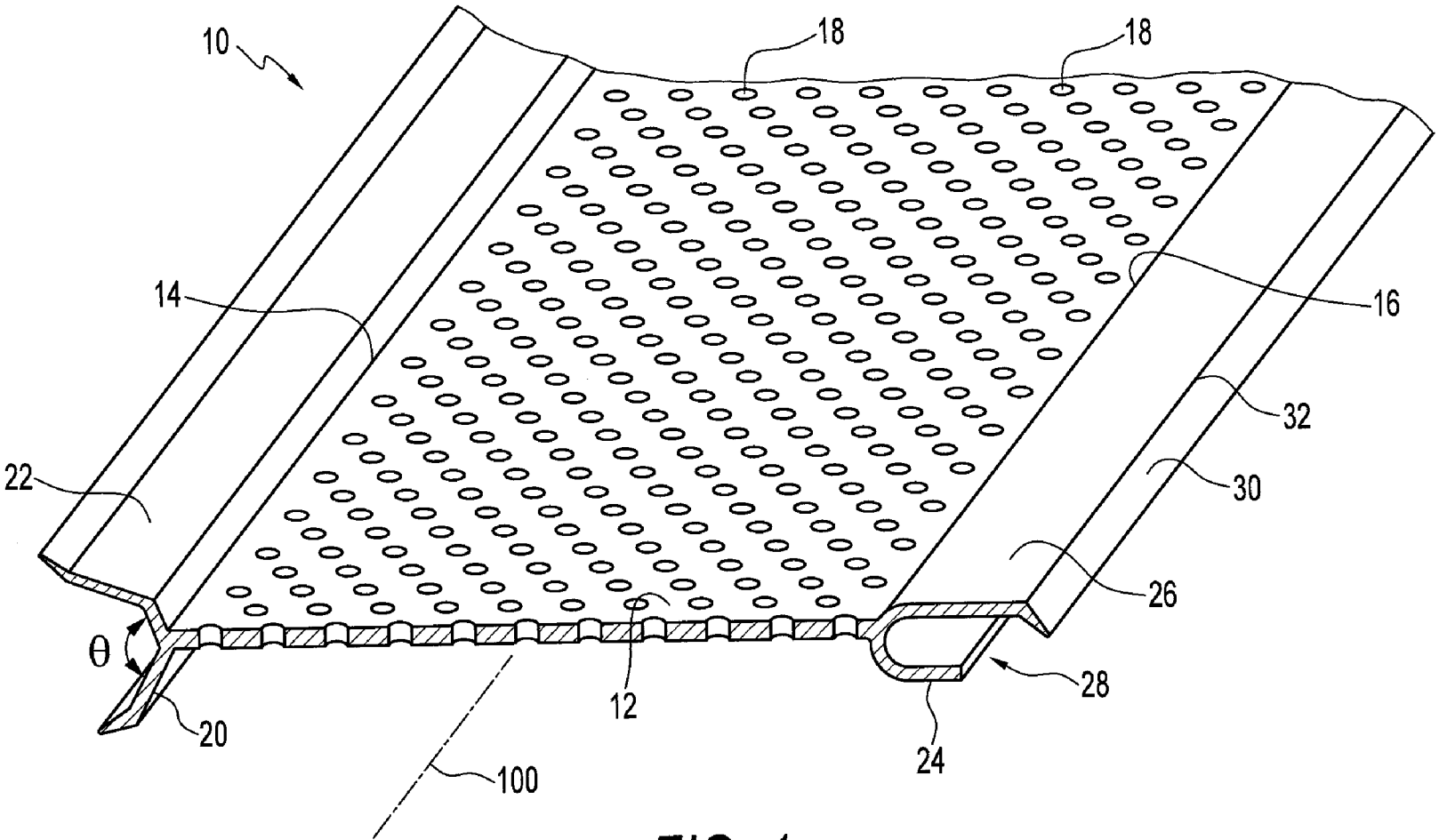
FIG. 1 is a fragmentary, top perspective view of a gutter guard according to an embodiment of the invention.
Figure 2:
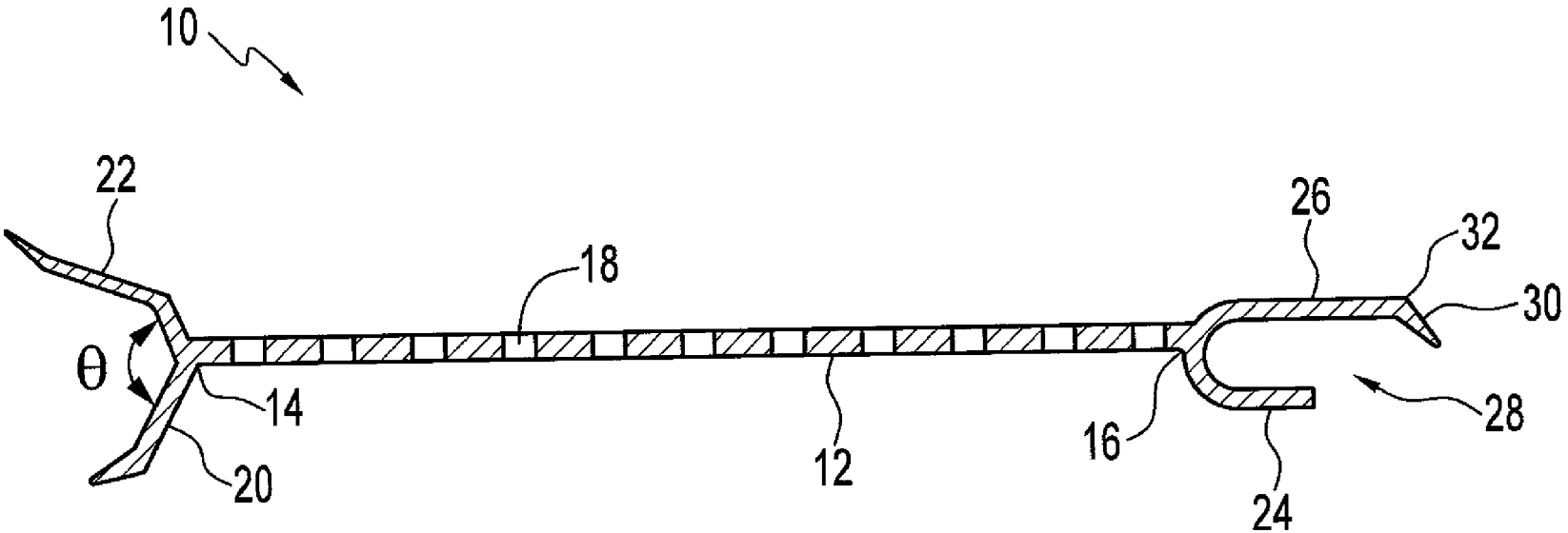
FIG. 2 is a cross-sectional, end view of the gutter guard of FIG. 1.

Referring to the drawings, and first to FIGS. 1 and 2, there is shown a gutter guard 10 according to a preferred embodiment of the invention. In this example the gutter guard is unitary; however, in other embodiments of the invention, the gutter guard may be comprised of inter-engaging components. The gutter guard 10 has an elongate, perforated planar portion 12. The perforated planar portion 12 has a first longitudinal edge 14 and a second longitudinal edge 16. There is a plurality of apertures 18 extending through the perforated planar portion 12. The apertures extend through the perforated planar portion 12 substantially perpendicular to a longitudinal axis 100 of the gutter guard 10. A flange 20 and a sealing member 22 are angularly spaced apart and extend along the first longitudinal edge 14 of the perforated planar portion 12. In this example the flange 20 extends angularly from perforated planar portion 12. Preferably, the sealing member 22 is flexible. The angle θ between the flange 20 and the sealing member 22 is between 20 degrees and 180 degrees, and preferably between 40 degrees and 80 degrees. A pair of spaced-apart side walls 24 and 26 define a channel 28 that extends along the second longitudinal edge 16 of the perforated planar portion 12. Preferably, the side walls 24 and 26 are resilient In other embodiments of the invention, the side walls 24 and 26 may be opposed or angularly spaced-apart. A lip 30 extends along a free edge 32 of one of the side walls 26.

Figure 3:
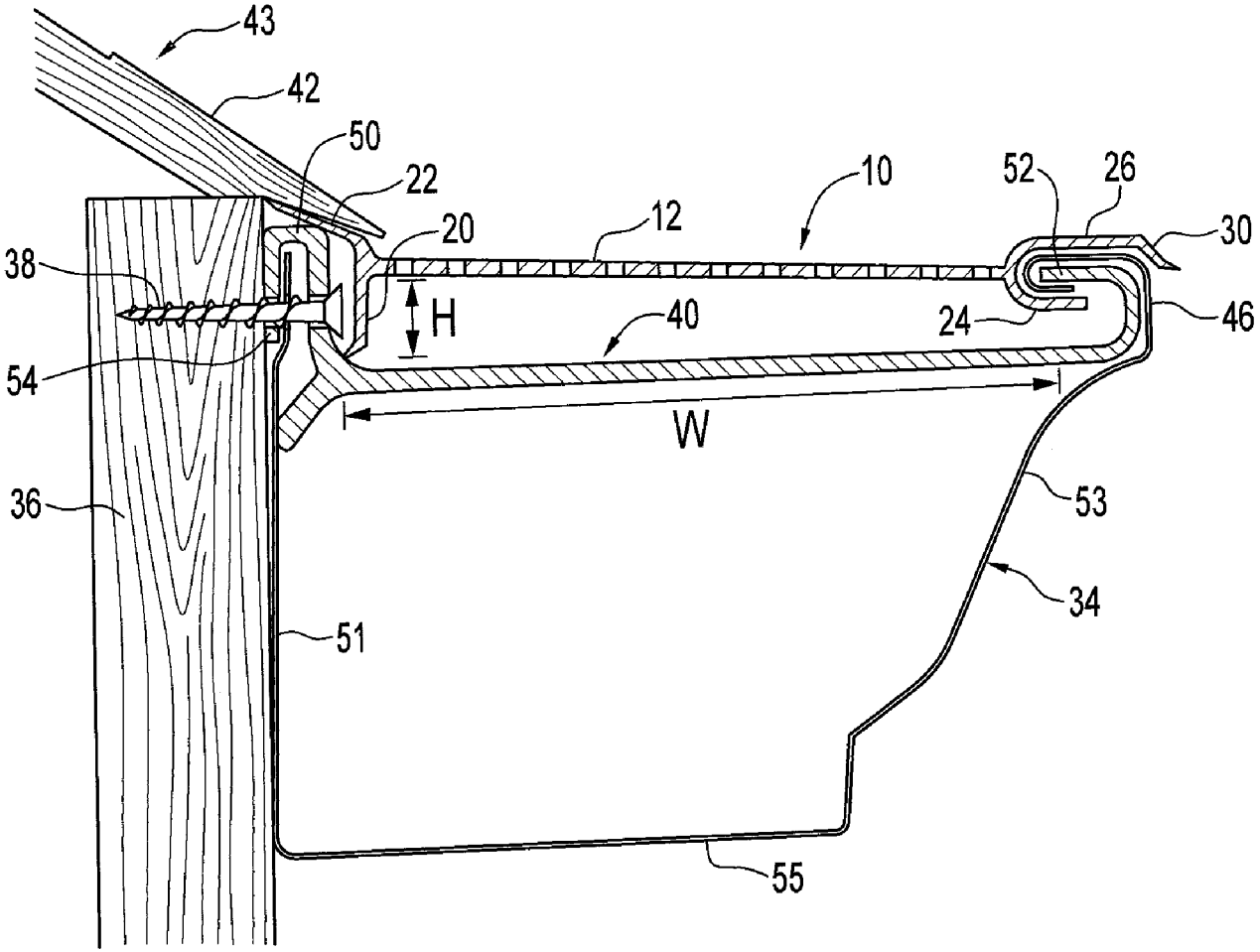
FIG. 3 is cross-sectional, end view of the gutter guard of FIG. 1 in sealing engagement with the longitudinal edges of a gutter.

Referring now to FIG. 3, the gutter guard 10 is shown in sealing engagement with longitudinal edges 50 and 52 of a gutter 34. The gutter 34 has a generally U-shaped cross-section defined by a pair of opposed longitudinal side walls 51 and 53, and a bottom wall 55 that extends between the side walls. The longitudinal side walls 51 and 53 have longitudinal edges 50 and 52, respectively. There is an upwardly facing opening 40 disposed between the longitudinal edges 50 and 52 of the gutter 34. The upwardly facing opening 40 has a width W. In use, the gutter 34 is installed below an eave 42 of a building 43. In this example, the gutter 34 is connected to siding 36 of the building 43 by fasteners in the form of screws 38, only one of which is shown in FIG. 3. The longitudinal edge 50 of the gutter 34 nearest to the building 43 may be referred to as an inner longitudinal edge, and the longitudinal edge 52 of the gutter 34 furthest from the building 43 may be referred to as an outer longitudinal edge. The perforated planar portion 12 of the gutter guard 10 prevents leaves and other foreign debris from entering the gutter 34 but allows water runoff from the building roof to flow into the gutter 34.

The gutter guard 10 slopes downwardly from the siding 36 as shown in FIG. 3. Preferably the downward slope is less than 10 degrees and remains constant in relation to the gutter 34. The slope remains constant because it is dependant only on the hanger bracket used and the width W of the gutter, both of which are largely industry standard items with minimal variation. This allows water runoff to push debris, which has not been blown off the gutter guard 10 by wind, over the lip 30 of the gutter guard 10. The slope of the gutter guard 10 is determined in part by the height H of the flange 20. The flexible nature of the sealing member 22 allows for adjustment of the slope. This allows the gutter guard 10 to fit different size gutters having different widths.

The flange 20 and sealing member 22 form a V-shaped member extending along the first longitudinal edge 14 of the perforated planar portion 12 of the gutter guard 10, and sealingly engage the inner longitudinal edge 50 of the gutter 34. This prevents any water accumulated on the perforated planar surface 12 of the gutter guard 10 from flowing over the inner longitudinal edge 50 of the gutter 34 and seeping into the building 43. The flange 20 extends downwardly into the gutter 34 and further acts as a shield for the screws 38. Preferably the height H of the flange 20 is between ½ an inch and ⅞ of an inch. The flange 20 should have a height H sufficient to extend past the screws 34, however, if the height H is too great the slope may become too steep. The flange 20 prevents water flowing into the gutter 34 from seeping into the siding 36 at a point of connection 54 between the gutter 34 and the siding 36. The sealing member 22 extends upwardly from the gutter 34 and underneath the eave 42. The sealing member prevents water runoff from flowing between the gutter 34 and the siding 36.

The spaced-apart side walls 24 and 26 of the gutter guard 10 act as a clip and sealingly engage the outer longitudinal edge 52 of the gutter 34, thereby maintaining the perforated planar portion 12 of the gutter guard 10 in a position adjacent the upwardly facing opening 40 of the gutter 34. The lip 30 of the gutter guard 10 extends outwardly beyond an outermost portion 46 of the gutter 34, causing water that may have accumulated on the perforated planar surface 12 of the gutter guard 10 to flow over the lip away from the gutter 34. This ensures that debris or water runoff will not flow down the outermost portion 46 of the gutter 34 and should prevent the "tiger stripe" effect that typically occurs when no lip 30 or drip edge is present.

Preferably, the gutter guard 10 is constructed of plastic. Plastic products are less prone to freezing than aluminium products and the slippery nature of plastic allows free movement of debris via wind or water runoff toward the lip 30 of the gutter guard 10. The plastic construction also allows the gutter guard 10 to be cleared by hand without fear of cutting or damage to the product as occurs with aluminum products. The preferred plastic is a polyvinyl chloride (PVC) extrusion that meets or exceeds strict standards set by the American Society for Testing and Materials (ASTM) for tensile and flexural strength, dimensional stability, and weather resistance. The advantage of using PVC is that PVC is rustproof and non-corrosive; lightweight, safe and easy to handle; easy to cut with common hand tools with no fear of sharp metal cuts; ultraviolet (UV) resistant; easy to store and ship without fear of damage; compatible with all gutter related products; and paintable.

Use of PVC has a further advantage because it is extremely strong allowing for at least twice as many apertures as compared to the competitive aluminum products. The increased number of apertures ensures that heavy rainfalls can be handled even if a substantial number of the apertures are clogged by debris. In the present invention, the apertures 18 preferably have a diameter of ⅛ of an inch and there are approximately 30 apertures per square inch. A diameter of ⅛ of an inch is small enough to prevent a majority of debris from entering the gutter 34. Only an occasional pine needle or dirt will be allowed enter the gutter. This means that minimal maintenance of the gutter 26 is required. A competitive aluminum product would have to be of a thin gauge to support a similar number of apertures, however, a thin gauge will result in sharp holes that will hold debris and present a cut hazard. The use of PVC also addresses safety issues working around power lines.

The unitary nature of the gutter guard 10 allows it to be manufactured by extrusion through a single die. This allows for a rapid and inexpensive manufacturing process because independent clips are not required. Furthermore, the nature of PVC lends to less waste due to the durability product and the ease with which the product may be shipped and handled.

It will be understood by a person skilled in the art that the terms "upwardly", "downwardly","inwardly" and "outwardly" as used herein are used in relation to the position of the gutter 34 and the gutter guard 10 as shown in FIG. 3.

It will further be understood by a person skilled in the art that many of the details provided above are by way of example only and are not intended to limit the scope of the invention which is to be determined with reference to the following claims.

The invention claimed is:

1. A unitary gutter guard comprising:

an elongate perforated planar portion having a first longitudinal edge, a second longitudinal edge, and a plurality of apertures extending therethrough;

a flange extending angularly from the perforated planar portion along the first longitudinal edge of the perforated planar portion;

a flexible sealing member extending angulary from and along the first longitudinal edge of the perforated planar portion, the sealing member being angularly spaced-apart from the flange wherein an angle between the flange and the sealing member is between 40 degrees and 80 degrees;

a clip formed by a pair of resilient spaced-apart side walls extending along the second longitudinal edge of the perforated planar portion, the side walls defining a channel therebetween; and a lip extending along a free edge of one of said side walls.

2. The gutter guard as claimed in claim 1 where the gutter guard is a PVC extrusion.

3. A unitary gutter guard and a gutter, the gutter having a generally U-shaped cross-section defined by a pair of opposed longitudinal side walls and a bottom wall that extends between the side walls, the side walls each having a longitudinal edge, fasteners connecting the gutter to a building, one said longitudinal edge nearest to the building being an inner longitudinal edge and another said longitudinal edge furthest from the building being an outer longitudinal edge, an upwardly facing opening of the gutter being disposed between the inner and outer longitudinal edges, the gutter guard being disposed adjacent to the upwardly facing opening of the gutter, and the gutter guard comprising:

an elongate perforated planar portion having a first longitudinal edge, a second longitudinal edge, and a plurality of apertures extending therethrough;

a flange extending angularly from the perforated planar portion along the first longitudinal edge of the perforated planar portion;

a flexible sealing member extending angulary from and along the first longitudinal edge of the perforated planar portion, the sealing member being angularly spaced-apart from the flange wherein an angle between the flange and the sealing member is between 40 degrees and 80 degrees and said fasteners are disposed between the flange and the flexible sealing member;

a pair of resilient spaced-apart side walls extending along the second longitudinal edge of the perforated planar portion, the side walls defining a channel therebetween; and a lip extending along a free edge of one of said opposed walls.

4. The gutter guard as claimed in claim 3 wherein the side walls form a clip, the clip sealingly engaging the outer longitudinal edge of the gutter.

5. The gutter guard as claimed in claim 3 wherein the lip extends outwardly and beyond the gutter.

6. The gutter guard as claimed in claim 3 wherein the flange extends downwardly into the gutter and beyond said fasteners.

7. The gutter guard as claimed in claim 3 wherein the sealing member is sealed against the building above the inner longitudinal edge of the gutter.

8. A unitary gutter guard for sealing both longitudinal edges of a gutter, the gutter guard comprising:

an elongate perforated planar portion having a first longitudinal edge, a second longitudinal edge, and a plurality of apertures extending therethrough;

a V-shaped member extending along the first longitudinal edge of the perforated planar portion for sealing a first longitudinal edge of the gutter, the V-shaped member including a flange extending angularly from and along the first longitudinal edge of the perforated planar portion and a flexible sealing member extending angularly from and along the first longitudinal edge of the perforated planar portion, the sealing member being angularly spaced-apart from the flange;

a clip formed by a pair of resilient spaced-apart side walls extending along the second longitudinal edge of the perforated planar portion, the side walls defining a channel therebetween for sealing a second longitudinal edges of the gutter; and a lip extending along a free edge of one of said side walls.

* * * * *